US005386918A

United States Patent [19]

Neveras et al.

[11] Patent Number: 5,386,918

[45] Date of Patent: Feb. 7, 1995

[54] CLOSURE WITH TAMPER EVIDENCE STRUCTURE

[75] Inventors: George J. Neveras, Kendall, N.J.; Claude Blasin, Brussels, Belgium

[73] Assignee: Colgate-Palmolive Co., New York, N.Y.

[21] Appl. No.: 52,024

[22] Filed: Apr. 22, 1993

[51] Int. Cl.[6] ..... B65D 41/32; B65D 41/62

[52] U.S. Cl. ..... 215/235; 215/254; 215/237; 220/254; 220/266; 220/339; 222/556

[58] Field of Search ..... 215/235, 254, 237, 256; 220/254, 266, 276, 339, 337; 222/546, 556

[56] References Cited

U.S. PATENT DOCUMENTS

| | | | |
|---|---|---|---|
| 4,487,324 | 12/1984 | Ostrowsky | 215/253 |
| 4,519,517 | 5/1985 | Walter | 215/253 |
| 4,638,916 | 1/1987 | Beck et al. | 215/235 |
| 4,696,408 | 9/1987 | Dubach | 215/237 |
| 4,759,455 | 7/1988 | Wilson | 215/206 |
| 4,782,964 | 11/1988 | Poore et al. | 215/216 |
| 4,911,324 | 3/1990 | Dubach | 220/339 |
| 5,069,367 | 12/1991 | Salmon et al. | 222/153 |
| 5,094,361 | 3/1992 | Dubach | 222/81 |
| 5,141,138 | 8/1992 | Odet et al. | 215/254 X |

*Primary Examiner*—Allan N. Shoap

*Assistant Examiner*—Vanessa Caretto

*Attorney, Agent, or Firm*—Michael J. McGreal; Robert C. Sullivan

[57] ABSTRACT

Disclosed is a closure for a container, the closure having a lid hinged to a base. The base of the closure has structure for locking the closure on a dispensing nozzle of the container. The closure has tamper evidence structure, to indicate whether the lid and base have been separated (that is, whether the closure has previously been opened). The tamper evidence structure includes a tear band; the closure cannot be opened without removal of the tear band. The closure is configured, and positioned relative to the dispensing nozzle, such that relatively little area of the closure contacts the material dispensed from the container as the material is dispensed, thereby reducing absorption of material components (e.g., flavors and/or oils of the material dispensed) by the closure. The top surface of the closure lid is configured such that the container and closure can be stably stood on end on the closure lid when the lid is in the closed position. The closure can be held at least two positions on the dispensing nozzle, a first position where the closure is locked on the dispensing nozzle and a second position where the closure is held on the dispensing nozzle but not locked thereon.

14 Claims, 3 Drawing Sheets

CLOSURE WITH TAMPER EVIDENCE STRUCTURE

BACKGROUND OF THE INVENTION

The present invention relates to a closure, for a container (e.g., a container for dispensing a viscous product), having structure indicating whether the closure has previously been opened (that is, having tamper evidence structure). In particular, the present invention is directed to such closure for a collapsible tube dispensing container. The present invention also relates to such a closure, having such tamper evidence structure indicating whether the closure has previously been opened, wherein absorption by the closure, of components of material to be dispensed from the container, is avoided. The present invention is also directed to an assembly of such closure, as discussed previously, and a container for dispensing a material.

More particularly, the present invention is directed to a closure having a snap hinge connecting a base and a lid of the closure, the closure having such tamper evidence structure which acts as evidence that the closure has been tampered with (that the closure has previously been opened), such closure being used on a dispensing container having a dispensing nozzle. Especially, the present invention is directed to such a closure for a collapsible tube dispensing container containing a dentifrice (e.g., a toothpaste or gel), and wherein absorption by the closure of oils and flavors from the dentifrice, as the product is dispensed, is avoided.

Various closures having a closure base and a closure lid connected by, e.g., a snap hinge, to be used on a dispensing tube having a dispensing nozzle, have been known and used in the art for a-number of years. For example, an early closure of this type is shown in U.S. Pat. No. 1,928,445, which discloses a rubber hinge connecting a cap to a base portion. The base is a threaded annular shaped member attached to a threaded dispensing outlet of a tube, the cap portion being hinged to the base and can be manipulated from a closed position to seal off the outlet of the tube to a fully opened position. This closure has a rubber film hinge attached to a base and cap that will bias the cap either in an open position or in a closed position.

Another form of a captive cap for a tube is shown in U.S. Pat. No. 3,933,271. This cap (closure) has a base portion for threading the cap onto a flexible toothpaste tube, and a cap portion connected to the base by a snap hinge. When the cap is opened to a point less than an intermediate position, the cap is biased closed. When the cap is pivoted open to a position past the intermediate position, the cap is biased open. The hinge design is biased for this action of the cap.

Dispensing containers having structure which indicates whether the package has previously been opened, so as to avoid purchase, by an unsuspecting consumer, of product that has been tampered with, are known. For example, a container entirely covered with a plastic sheeting material (e.g., a shrink wrap), is known. Such container covered with a plastic sheeting material can be sold, for example, with instructions that if the shrink wrap is torn, cut or missing, the product should not be used.

However, in certain countries the shrink wrap sheeting material covering the entire container constitutes a second package, with disadvantages arising therefrom. Moreover, such containers entirely covered with sheeting material require a relatively large amount of shrink wrap sheeting material, as well as additional processing steps for packaging the container in the shrink wrap material.

U.S. Pat. No. 4,615,462 discloses an assembly of a one-piece snap hinge made of plastic and a container for longitudinally extending diagnostic test carriers. This patent discloses a hinge (or cap portion) permitting the manufacturing of complicated-shape containers such as, for example, a test strip container, in an injection molding process, without complicated molds. The hinge is made as a separate structural part, with one of the hinge parts being provided with plug-in parts for mounting on a container or on a locking piece of the container. As one aspect of the disclosed structure, there is described an originality safety for snap locks, made of plastic, for indicating that the lock already had been opened; such originality safety is described as including a tearable part engaged into an adaptable counterpiece, for example, a recess on a lower part of the lock (alternatively, plug pins available on the tearable part may be welded on a lower part).

U.S. Pat. No. 4,615,462 describes a snap hinge between two plate-like parts, e.g., extending horizontally across a top of a container, one of the two plate-like parts having the tearable part for originality safety, the container being a relatively complicated-shaped container for diagnostic test supports. The snap hinge is a closure different from that involved in the present invention (the present closure having a closure base and closure lid, and which can be used to close a dispensing container having a dispensing nozzle).

It is desired to avoid absorption, by the closure, of components of the product to be dispensed from the dispensing container, when dispensing the product. Specifically, it is desired to avoid absorption of flavor and/or oils of the material to be dispensed (e.g., a dentifrice such as a toothpaste or gel) by material of the closure, where such closure is provided on the dispensing container and has the above-referred-to tamper evidence structure. Co-pending U.S. patent application Ser. No. 7/973,810, filed Nov. 9, 1992 (Colgate-Palmolive Reference No. IR 5256), which is a Continuation-in-Part of U.S. application Ser. No. 07/800,173, filed Nov. 27, 1991, the contents of which Continuation-in-Part application are incorporated herein by reference in their entirety, discloses a closure adapted to accept a nozzle of a container such as a squeeze tube, the closure including a base cap and a cap lid hinged to the base cap by a snap hinge, the base cap including internal threads which mate with threads on the tube to attach the base cap to the tube, an opening being included in the base cap to define an axial passage for the contents of the tube. In one embodiment disclosed in the Continuation-in-Part patent application, the nozzle of the container extends axially through the base cap and projects above the upper surface of the base cap, with a lip on the central opening in the base cap snapping into an annular groove in the nozzle, the cap lid including an axial collar extending inwardly to engage the end of the nozzle and seal the nozzle when the cap lid is in the closed position. Through such structure, contact of the nozzle with the base cap during dispensing of the product can be avoided, thereby avoiding adsorption by the closure structure of flavor and/or oils from the dispensed product.

Even in light of the foregoing, it has still been desired to provide a closure locked to a dispensing container and having tamper evidence structure, and also avoiding adsorption of flavor and oils from the product when dispensing the product.

U.S. Pat. No. 3,503,544 discloses a closure for tubes containing toothpaste, shaving cream or any other material adapted to be extruded from the tube upon the exertion of pressure thereon. The tube is provided with a preferably integral head having a top surface which is flat and substantially perpendicular to the axis of the tube. The surface is provided with a straight, relatively wide, flat groove adapted to receive a flat cover hinged at one end to the head of the tube and having its free end projecting beyond the head to be readily accessible so that the user may hold the tube in one hand and flip the cover to an open position with a thumb. The cover is provided with a tapered plug adapted to enter the outlet opening of the tube when the cover is closed. The top surface of the cover is flat throughout its area so that when the cover is closed, the tube may be inverted and the surface of the cover placed on a flat surface whereby the tube will remain in a standing position without support. The top surface of the head is flat and lies in the plane of the top surface of the cover so that the tube will remain standing in inverted position with a substantial degree of stability.

U.S. Pat. No. 5,067,624 discloses a plastic closure for containers, having a lid and closure body which are attached by a snap hinge. The snap hinge has a film hinge and intermediate elements on either side of the film hinge. The intermediate elements have little or no extensibility, so that, when the lid snaps open or shut, other portions of the closure are resiliently deformed. The closure body includes catch projections for fixedly connecting the closure to a container neck, the catch projections being held under an outer bead on the neck.

While the foregoing patents and patent application evidence the background for closures for dispensing containers, there is not shown a closure having a closure lid and closure base, particularly adapted for use with a dispensing container having a nozzle, to be fixed on the dispensing container and which contains tamper evidence structure indicating whether the closure had previously been opened. In particular, there is not shown a closure to be fixed (locked) on a dispensing container, having such tamper evidence structure indicating whether the closure had previously been opened, and wherein adsorption by the closure of components from the material to be dispensed, during dispensing of the material, is avoided or at least substantially reduced. Further, there is not shown such closure, having the tamper evidence structure, and wherein adsorption, by the closure, of components from material to be dispensed, is avoided, and further wherein the container can be stood on end on the closure. In addition, there is not shown such closure, having the tamper evidence structure and wherein adsorption by the closure of components from material to be dispensed is avoided, and further wherein the closure can be positioned in a plurality of positions on the dispensing container, including one in which the closure is held locked onto the dispensing container and a second in which the closure is held on the tube in an unlocked position (such that the tube can be transported on filling equipment, if necessary).

SUMMARY OF THE INVENTION

Accordingly, it is an object of the present invention to provide a closure, for a container, having tamper evidence structure indicating whether the closure has previously been opened; and to provide an assembly of (1) a container and (2) a closure having such tamper evidence structure closing off the opening (dispensing outlet) of such container.

It is a further object of the present invention to provide a closure having tamper evidence structure indicating whether the closure has previously been opened, for use on a container having a dispensing nozzle; and to provide an assembly of such closure and such container, particularly where the closure is attached on the nozzle.

It is a further object of the present invention to provide such closure, having tamper evidence structure and adapted to be fixed on a container (in particular, a container having a dispensing nozzle for dispensing material from the container), wherein adsorption by the closure of components (e.g., flavors and/or oils) from the material to be dispensed, during dispensing of the material, is avoided; and to provide an assembly of such closure together with the container.

It is a further object of the present invention to provide a closure having tamper evidence structure and wherein such adsorption of flavors and/or oils by the closure is avoided, and further wherein the container can be stood on such closure; and to provide an assembly of a container and such closure.

It is a still further object of the present invention to provide a closure formed of an integral member having a closure base and closure lid, with a hinge (e.g., a snap hinge) connecting the closure base and closure lid so that the closure can be opened or closed, the closure having tamper evidence structure.

It is a still further object of the present invention to provide a closure having tamper evidence structure for indicating whether the closure has previously been opened, which closure can be held in a plurality of positions on the container, including at least a first position where the closure is locked onto the container and a second position where the closure is not locked on the container but is held on the container.

It is a still further object of the present invention to provide a closure having tamper evidence structure, which can be used with a collapsible tube, having a nozzle, as the container.

It is a still further object of the present invention to provide a closure having tamper evidence structure and wherein absorption by the closure of flavors and/or oils from the material to be dispensed can be avoided, to be used with a collapsible dispensing tube for dispensing dentifrices such as toothpastes and gels; and to provide an assembly of such closure and such dispensing tube.

The foregoing objects are achieved by the present invention, which includes a closure having a closure base fitted on the container (for example, fitted on a nozzle of the dispensing container), and having a lid for closing against the closure base (so as to close off the outlet of the container). Either the lid or base has tamper evidence structure attached thereto, which cooperatively acts with the other of the lid and base to indicate whether the lid has been separated (opened) from the base. Specifically, either the lid or base has a tear band for indicating whether the lid of the cap has been separated (opened) from the base.

The closure base is locked to the container; specifically, the base is locked on the nozzle of the dispensing container, to a shoulder at a lower portion of the nozzle. The nozzle extends up through the closure base to at least substantially the top of the closure base (and can extend beyond the top of the closure base), so that the product at most contacts only a relatively small area of the closure during dispensing, whereby absorption of components of the material dispensed (for example, flavors and/or oils of the product dispensed) by the closure can be avoided or at least substantially reduced.

Desirably, the tear band has bridging portions attaching the tear band to the closure base or lid, the bridging portions being sufficiently weak such that the tear band can be separated from the closure base or lid by tearing the bridging portions. The tear band forms openings with the base or lid to which it is attached; and the other of the base or lid has projections (nibs) which fit in the openings to hold (lock) the base to the lid. By removal of the tear band, projections are no longer locked in the openings, so that the lid can be opened. However, without removal of the tear band, the base and lid are locked to each other, so that opening of the dispensing container cannot be achieved (because the closure base is locked to the container and the closure base is locked to the closure lid, the container outlet cannot be exposed).

According to the present invention, the closure lid, on its top surface, has a substantially flat portion, on which the container can be stood. The substantially flat portion is relatively large, so that the container can stably stand on end.

The closure base has, desirably, projecting portions which co-act with projecting portions on, e.g., a shoulder of the nozzle (at a lower portion of the nozzle) of the dispensing container, to lock the closure at a first catch area on the dispensing container. The shoulder can have a plurality of catch areas, a first to lock the closure on the shoulder and a second to, e.g., temporarily (nonpermanently) hold the closure on the container, e.g., when transporting the container on filling equipment.

While such projecting portions have been disclosed as structure for locking the closure base on the shoulder, such description is illustrative and not limiting. Other structure for locking the closure base on the dispensing container can be utilized.

Accordingly, by the present invention a closure is provided having tamper evidence structure, yet which can fit over a dispensing container nozzle (and close off such nozzle). Moreover, a closure having tamper evidence structure is provided whereby absorption by the closure of components (e.g., flavor and/or oils) from the product to be dispensed can be avoided. Furthermore, a closure is provided having tamper evidence structure, yet which can be held on the dispensing container in a non-locking condition (e.g., when transporting the container on filling equipment). Moreover, a closure is provided having such tamper evidence structure and wherein the container can be stably stood on end on the closure.

DETAILED DESCRIPTION OF THE INVENTION

Figure 1:
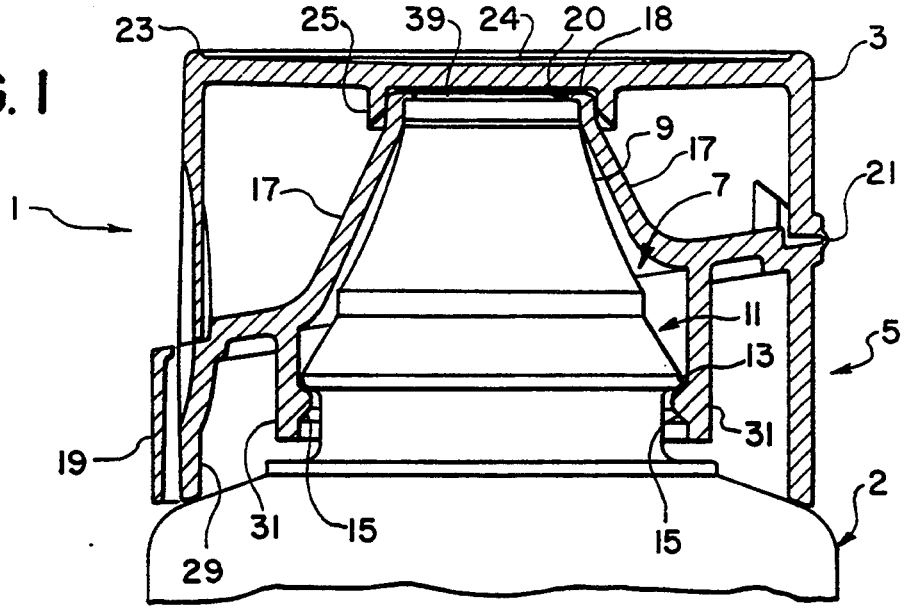
FIG. 1 is a cross-sectional view of a first embodiment of the closure of the present invention, locked on a dispensing container.

In the following paragraphs, the present invention will be described in connection with specific and preferred embodiments. It is to be understood that these specific and preferred embodiments are illustrative of the present invention, and not limiting thereof, it being intended that the present invention cover all alterations, modifications and equivalents as may be included within the spirit and scope of the invention as defined .by the appended claims.

In the present specification, where it is described that the apparatus comprises or includes specific components and/or is made of specific materials, it is to be understood that it is within the scope of the present invention that the apparatus consists essentially of, and consists of, the specific structure, and is made of materials consisting essentially of, and consisting of, the recited materials.

The present invention contemplates a closure having a lid and a base, with tamper evidence structure; such tamper evidence structure can be, for example, a tear band attached to either the lid or the base and cooperatively acting with the other of the lid or base to keep the lid locked on the base until removal of the tear band. Preferably, the tear band is provided on the lid, and is connected to the lid by bridging portions. Recesses are formed in the tear band. The base has nib portions which fit into these recesses, and are locked in these recesses, when the lid is closed on the base. The lid can only be separated from the base by removal of the tear band, which frees the nibs on the base from the recesses. These recesses could be openings in the tear band.

Of course, the tear band can also be provided on the base, with recesses being formed on the tear band. This would be provided with nibs on the periphery of the lid fitting into such recesses so as to lock the lid and base together.

Preferably, the closure lid and closure base are integrally formed, and connected by a hinge which is also integral with the lid and base. Thus, according to a preferred embodiment of the present invention the closure lid, hinge and closure base are a single member.

Illustratively, the hinge is preferably a "snap hinge", e.g., an integral, living or film hinge, and acts to either keep the lid closed on the base or open a substantially maximum amount from the base, but not stably keep the lid at positions therebetween. Such "snap hinge" is known in the art, as shown, for example, by previously discussed U.S. Pat. Nos. 3,933,271 to McGhie and U.S. Pat. No. 5,067,624 to Thanisch.

In a preferred embodiment, the tear band, which is attached to the closure lid, extends to the bottom of the closure base when the lid is closed on the base, and has a varying width (that is, has a dimension that varies in the direction from top to bottom of the closure, at different locations around the periphery (e.g., circumference) of the closure). The tear band can extend around the entire periphery of the closure, or, e.g., can extend around about ½ the periphery of the closure; this extent of the tear band is illustrative, and not limiting.

Preferably, the closure is formed by molding, as one piece, as known in the art in connection with, e.g., plastic closures for containers. Injection molding is appropriate for forming the closure. The closure is desirably formed of a plastic such as polyethylene or polypropylene, or copolymers or block polymers thereof.

A disadvantage of each of polyethylene and polypropylene is that these materials can absorb components, such as flavors and/or oils, from the product to be dispensed. Illustratively, where the product dispensed is a dentifrice such as a toothpaste or gel, the dispensing container being a squeeze tube, a disadvantage arises when utilizing polyethylene or polypropylene for the closure in that flavors and oils from the dentifrice are absorbed in the closure where the product contacts the closure. This problem is avoided by forming the closure such that the product dispensed through the container nozzle contacts substantially little area of the closure; or, does not contact the closure (specifically, the closure base) at all.

Desirably, the nozzle of the dispensing container has a substantially conical shape. Thus, the nozzle has a conical shape that tapers toward the outlet (the larger end of the nozzle being adjacent the main body of the container). The opening, for the nozzle, in the closure base, is sufficiently large such that the nozzle passes through substantially all of the closure base structure so that product substantially does not contact the closure base.

Where the nozzle is formed of, e.g., polyethylene or polypropylene, a barrier layer is preferably provided on the inner surface of the nozzle, so as to avoid the nozzle absorbing, for example, flavors and/or oils of the product dispensed (e.g., a dentifrice).

The nozzle, including shoulder portions, can be formed by injection molding; and the dispensing container (for example, a squeezable tube, e.g., for holding dentifrice) can be formed by extrusion molding, as known in the art. Typically, the tube is formed from a flexible plastic film material, although other materials such as metal foils may be used. When the tube is formed of a plastic material, the bottom seam is formed by welding, as known in the art. The nozzle can be integrally formed with the tube; alternatively, however, the nozzle may be manufactured as an assembly and attached to the tube by welding or by an adhesive.

In a preferred, embodiment, the nozzle preferably has at least two catch areas on the shoulder thereof, for holding the closure on the dispensing container. The first catch area is defined by a relatively large projection such that after projections on the closure base passe beyond the relatively large projection, to the first catch area, the closure is locked on the dispensing container; and also includes a second catch area, defined, e.g., by two projections on the shoulder, whereby the projections on the closure base are positioned in a shallow depression between these two projections on the shoulder, such that the closure is not locked on the dispensing container but rather can be easily removed therefrom. The latter position, at the second catch area, is desirable in order to retain the closure on the dispensing container, e.g., for transport to the final assembly station, without locking the closure on the dispensing container.

The closure lid is preferably round, and is either flat or has a flattened portion on its top, when the closure is closed, so that the dispensing container can be stood on end, stably, on the closure lid. Such storing on end has the advantage that the dispensing container takes up relatively little space for storage; and, moreover, will enable the product to collect around the dispensing opening.

In the following, the present invention will be described in terms of specific examples thereof. These specific examples are illustrative of, and not limiting of, the present invention, whose intended scope is defined by the appended claims.

The specific examples of the present invention, described in the following, will be discussed in connection with the drawing figures. In these drawing figures, structure having substantially similar function in the various drawing figures have been denoted by the same reference characters.

FIG. 1 shows the closure and dispensing container according to a first embodiment of the present invention, with the closure being closed and having the tamper evidence structure attached thereto. Specifically, closure 1 is locked on dispensing container 2 (which can be, for example, a squeezable tube holding a dentifrice). The closure 1 contains a closure lid 3 and closure base 5. The closure base surrounds a nozzle 7, having conical spout 9 and shoulder portion 11. The shoulder portion 11 has shoulder projection 13, which cooperatively act with closure base projection 15 to lock the closure on the nozzle. Illustratively, shoulder projection 13 is a projection extending around the entire periphery of the nozzle 7. The closure base includes dispensing channel 17 and inner closure base member 31 extending therefrom, the inner closure base member 31 having closure base projection 15 thereon for locking the closure on the dispensing container. The closure also includes outer closure base member 29. As seen in, e.g., FIG. 1, the outer closure base member 29 provides, e.g., a smooth line from the main body of the container to the closure, and helps prevent tampering with the locking between the closure and the container at projections 13, 15. The finger grip 8 assists in opening the closure.

As can be seen in FIG. 1, the closure lid 3 has a support portion 23 which provides a relatively flat surface (which is an annular surface formed at the circumference of the top of the closure lid) for stably supporting the closure and dispensing container on end. The central portion 24 of the top surface of closure lid 3 is concave in configuration, so as to enable the container to be stably supported, on end, by support portion 23.

The closure base 5 and closure lid 3 are operatively connected to each other by hinge 21. When closed, the closure lid 3 fits into recess 12 of the closure base 5. As seen most clearly in FIG. 3, hinge 21 includes a central hinge portion 43 and intermediate portions 41 and 45, as known in the art. While the hinge is shown as a 3-part hinge, the closure according to the present invention is not restricted to any particular hinge type; and, e.g., it can be a film hinge, as shown in U.S. Pat. No. 4,403,712 to Wiesinger, or other known snap-type hinges. Also shown, for example, in FIGS. 1–3 is lid closing member 25, which acts together with dispensing channel 17 of the closure base to close off the opening 39 through the closure base, through which the product is dispensed through spout 9 from dispensing container 2.

Figure 2:
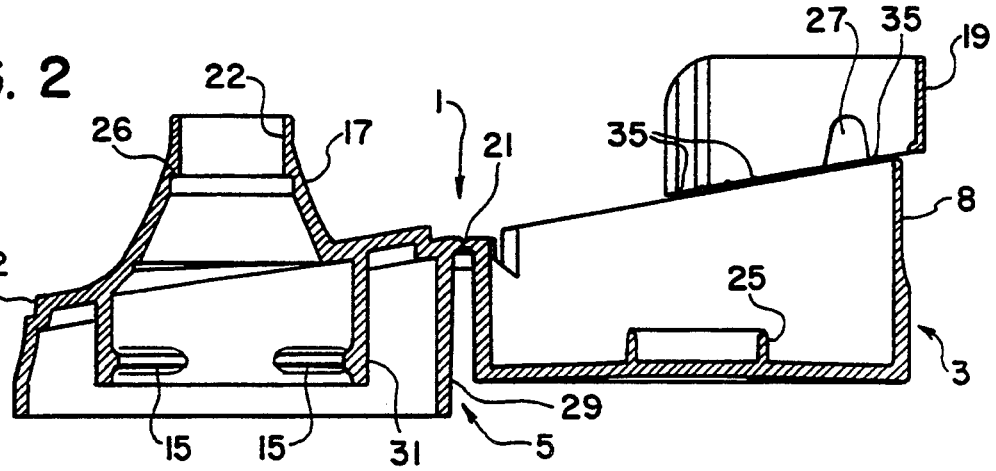
FIG. 2 is a cross-sectional view of the closure of a second embodiment according to the present invention.
Figure 3:
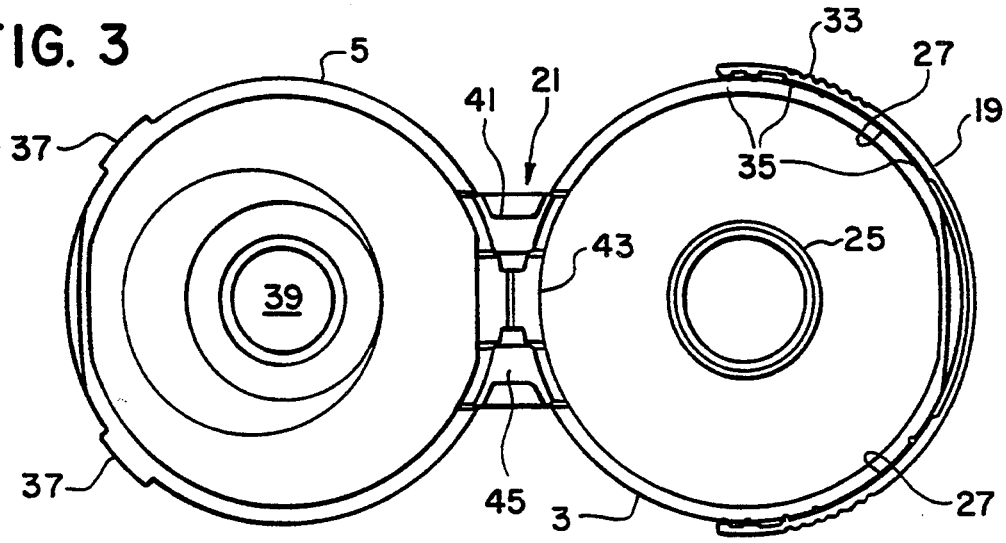
FIG. 3 is a top view of the closure of the second embodiment according to the present invention.
Figure 4:
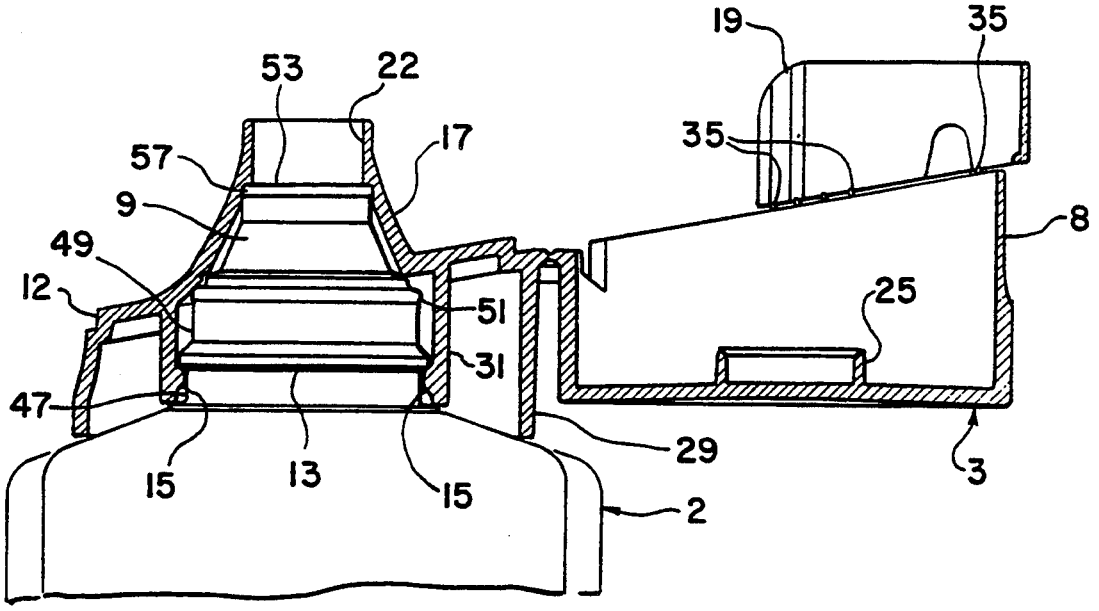
FIG. 4 is a cross-sectional view of a closure and dispensing container according to the second embodiment of the present invention, showing the closure locked on the dispensing container.

The tamper evidence structure can be seen most clearly in FIGS. 2 and 3. Attached to closure lid 3 is tear band 19. Tear band 19 is attached to the lid 3 by bridging portions 35; as seen in FIG. 3, the tear band 19 extends, for example, half way around the circumference of the closure lid. The tear band 19 includes roughened portions 33, for grabbing the tear band when removing the tear band 19 from the lid 3. The bridging portions 35 are sufficiently small in number, and sufficiently weak, such that the consumer can separate the tear band 19 from the closure lid 3, by tearing the bridging portions, without difficulty.

As seen in FIG. 2, recesses 27 are provided between the tear band 19 and lid 3; such recesses cooperate with nibs 37 on the closure base 5 (that is, the nibs 37 extend into such recesses 27) such that the closure lid 3 is locked to the closure base 5, and separation between the lid and closure base can only be achieved through removal of the tear band (which, correspondingly, frees the nibs 37 from the recesses 27).

As shown, for example, in FIG. 1, the tear band 19 desirably extends to the bottom of the closure base.

As seen most clearly in FIG. 1, projection 15 extends beneath, and co-acts with, projection 13 on shoulder 11 of the dispensing nozzle 7 to lock the closure 1 on the dispensing container 2. As seen in FIG. 1, movement of the closure 1 on the dispensing container 2 is limited by the cooperative actions of projections 15 and 13, together with lip 18 of nozzle surrounding member 17 extending on top of the nozzle. The dispensing nozzle 7 will seal against the lower surface lip 18 when assembled. Note that the product dispensed will only contact a small area of the closure (that is, face 20 of extension 18), so as to achieve an objective of the present invention of substantially avoiding product contact with the closure so as to avoid absorption by the closure of components of the product dispensed.

While FIG. 1 shows small contact of the product with the closure, it is the objective that the contact of the products with the dispensing channel be minimized. Consequently, the nozzle 7 should extend to a point immediately adjacent the end of the dispensing channel. Preferably, the product should contact less than about twenty percent of the surface area of the dispensing channel and ideally less then about ten percent. This is accomplished in FIG. 1 through the use of lip 18 designed to mate with the top surface 53 of the container. This results in a minimum contact area of the product with the closure. In FIG. 2–6 there is shown a second embodiment where the container will terminate in the area of surface 26 with the product contacting the surface 22 of the closure. In one instance lip 18 will sealingly contact the top 53 of the container while in the other, the top 53 will sealingly contact the top of region 26. The side surface 57 of the spout also will sealingly engage the dispensing channel. Conical section 9 will interconnect the spout top 53 with the lower sections.

In use, the closure 1 can be placed on the dispensing container by slipping the closure base over the nozzle until projections 15 on the inner closure base member 31 are caught by shoulder projections 13. The closure is then locked on the dispensing container. Moreover, the closure lid 3 and closure base 5 are locked in a closed position due to nibs 37 passing into the recesses 27 between the tear band 19 and closure lid 3. Upon separation of tear band 19 from the closure lid 3, the closure lid can be opened so as to expose the outlet of nozzle 7, and to dispense product.

Accordingly, the presence of the tear band 19, with the nibs 37 extending through recesses 27 formed by tear band 19, establishes that the closure has not been opened (that is, that the closure base has not previously been separated from the closure lid, so as to expose the nozzle outlet), yet opening of the closure is simple through removal of the tear band 19. Recesses 27 can be openings located at the same place and being partially or fully through band 19.

In the foregoing embodiment, shoulder projection 13 cooperatively act with closure base projection 15 so as to lock the closure on the dispensing container. In a second embodiment, and as shown in FIG. 6, the shoulder portion 11 of nozzle 7 includes two catch areas, a first catch area 47 and a second catch area 49. The first catch area is provided beyond shoulder projection 13 (that is, between shoulder projection 13 and the dispensing container 2); and the second catch area 49 is provided between shoulder projection 13 and further shoulder projection 51. Further shoulder projection 51 can be a projection extending around the entire periphery of nozzle 7. According to this aspect of the present invention, and as shown most clearly in FIGS. 4 and 5, where closure base projections 15 are positioned underneath shoulder projection 13, in the first catch area 47, the closure is locked on the dispensing container. See FIG. 4. It is in this position of the closure that the dispensing container, filled with product, is sold to the consumer, providing tamper evidence structure as discussed previously.

Figure 5:
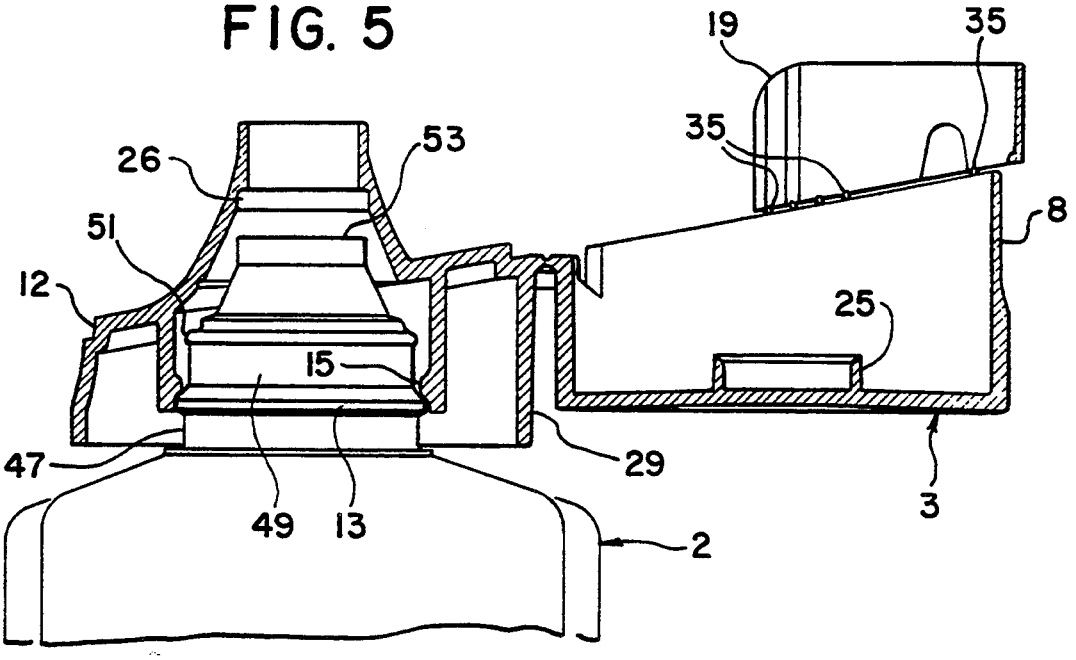
FIG. 5 is a cross-sectional view showing the closure and dispensing container according to the second embodiment of the present invention, wherein the closure is held, but not locked, on the container.
Figure 6:
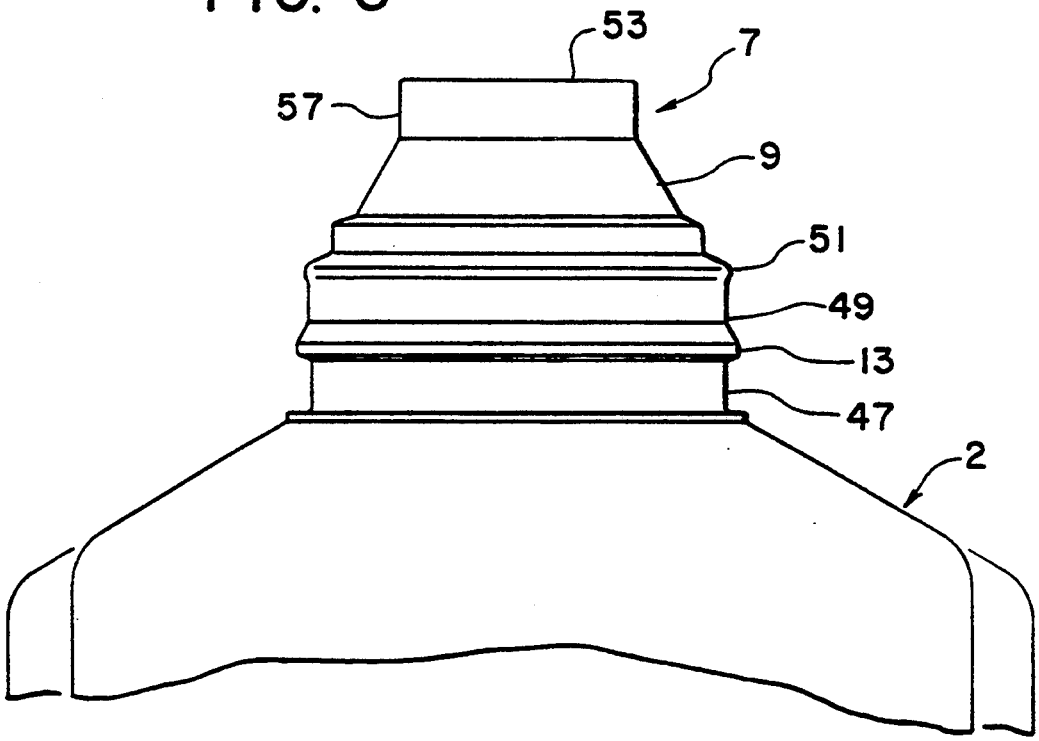
FIG. 6 shows the nozzle of the dispensing container according to the second embodiment of the present invention.
Figure 7:
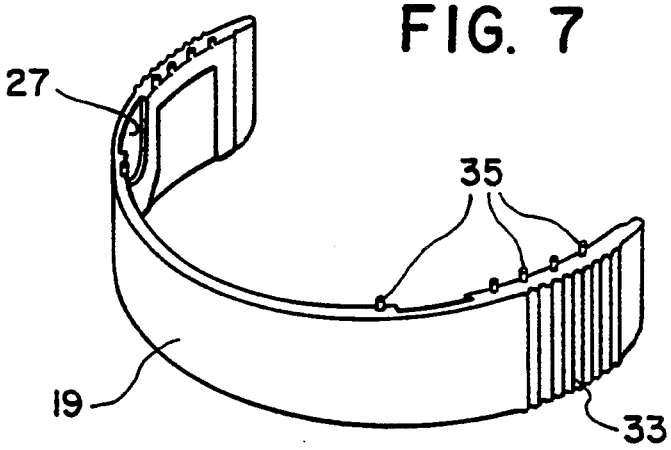
FIG. 7 is a perspective view of the tear band removed from the closure.
Figure 8:
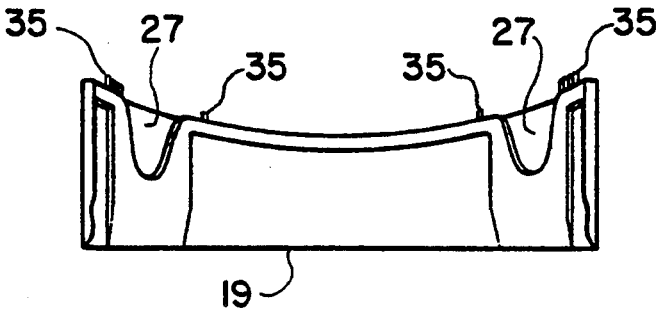
FIG. 8 is an inner elevational view of the tear band.

However, in this embodiment, prior to locking the closure on the dispensing container, the closure can be held on the dispensing container without being locked thereon, as shown in FIG. 5. As seen in FIG. 5, and in more detail in FIG. 6, the second catch area 49 is a relatively shallow depression provided between shoulder projection 13 and further shoulder projection 51, and enables the closure 1, for example, to be either removed from the dispensing container or pushed further on the dispensing container so as to lock the closure 1 on the dispensing container 2. This non-locked positioning of the closure on the dispensing container, where the closure base projections are located at the second catch area 49, is useful in, for example, transporting to the final assembly station, if needed.

As with the previously discussed embodiment, upon initial use of the product by the consumer the tear band 19 must be removed; e.g., by separating the tear band from the closure lid by tearing the bridging portions 35. To dispense contents of the container, the lid 3 is flipped to the open position and, e.g., where the dispensing container is a squeezable tube, a dispensing force is applied to the sidewalls of the tube to force the contents of the tube through the nozzle. After dispensing of product, the closure lid 3 can be flipped to the closed position, due to use of the snap hinge 21, and the container then stored on the closure lid.

As indicated previously, the closure in preferred embodiments is made of molded plastic material (formed by, e.g., injection molding), as a unitary piece. Suitable plastic materials include, for example, polyethylene and polypropylene. The tube is similarly formed from a suitable plastic material such as multilayers of polyolefin. In a preferred embodiment, the nozzle, shoulder and body of the tube are molded as an integral assembly. The tube and closure are particularly suitable for most viscous materials, such as dentifrices (toothpastes and gels) where small amounts are dispensed at a time. The closure provides a convenient and efficient means for attaching a closure to a tube so that the tube can be closed after each use, while providing a closure having tamper evidence structure indicating, prior to a first use of the tube by a consumer, whether the closure has previously been opened.

While we have shown and described several embodiments in accordance with the present invention, it is understood that the same is not limited thereto, but is susceptible to numerous changes and modifications as known to one having ordinary skill in the art, and we therefore do not wish to be limited to the details shown and described herein, but intend to cover all such modifications as are encompassed by the scope of the appended claims.

What is claimed is:

1. A closure for a container having a dispensing nozzle, comprising:

two parts hingedly connected:

a closure base part having a side wall and a top surface and a locking structure for the purpose of locking the closure to a container and a dispensing channel projecting upwardly from said top surface, said dispensing channel having a cross-sectional dimension to accept a dispensing nozzle of a container therein and having a sealing surface adjacent an exit opening thereof to contact said dispensing nozzle;

a closure lid part, cooperatively acting with said closure base so as to seal said opening when the closure lid is in a closed position; .

hinge structure connecting said closure base to said closure lid, the closure lid moving between an open and said closed position by movement around an axis of the hinge structure; and tamper evidence structure attached to one of said two parts hingedly connected and cooperatively acting with the other of said two parts to which it is not attached, to lock the closure lid to the closure base until removal of the tamper evidence structure.

2. The closure of claim 1, wherein said tamper evidence structure includes a tear band attached to the closure lid, such that the closure lid is locked to the closure base until removal of the tear band.

3. The closure of claim 2, wherein the tear band is attached to the closure lid by bridging portions, said bridging portions being sufficiently weak such that the tear band can be separated from the closure lid to which it is attached by pulling on the tear band manually.

4. The closure of claim 2, wherein recesses are formed in the tear band and the closure base has at least one nib for extending into said recesses on the tear band for locking the closure lid and closure base in the closed position.

5. The closure of claim 4, wherein the closure base has an end furthest from the closure lid, and wherein the tear band extends to said end of the closure base furthest from the closure lid.

6. An assembly comprising a container having a dispensing nozzle and a closure for such container, said closure comprising:

two parts hingedly connected;

a closure base part having an upper surface and a locking structure for the purpose of locking the closure to said container and a dispensing channel projecting upwardly from said upper surface, said dispensing channel having a cross-sectional dimension to accept said dispensing nozzle of said container therein and having a sealing surface adjacent an exit opening thereof wherein, said dispensing nozzle extending a distance into said dispensing channel to contact said sealing surface wherein the product to be dispensed contacts only a limited surface of the dispensing channel;

a closure lid part, cooperatively acting with said closure base so as to seal said opening when the closure lid is in a closed position;

hinge structure connecting said closure base to said closure lid, the closure lid moving between an open and said closed position by movement around an axis of the hinge structure; and tamper evidence structure attached to one of said two parts hingedly connected and cooperatively acting with the other of said two parts to which it is not attached, to lock the closure lid to the closure base until removal of the tamper evidence structure.

7. The assembly of claim 6, wherein the dispensing nozzle extends at least through substantially the entirety of the dispensing channel.

8. The assembly of claim 6, the dispensing nozzle includes a shoulder between an opening thereof for dispensing material and a main body of the container, said main body being for storing the material, wherein said shoulder includes at least one projection, and wherein said closure base includes at least one projection cooperatively acting with the at least one projection on said shoulder so as to provide said locking structure locking the closure to said container.

9. The assembly of claim 8, wherein said shoulder includes a first catching area and a second catching area, the first catching area being located between said at least one projection on the shoulder and the main body, the at least one projection of the closure base being positioned at the first catching area when the closure is locked to the container, the second catching area being located between the at least one projection on the shoulder and the opening of the dispensing nozzle, for holding the closure on the container without locking the closure on the container.

10. The assembly of claim 6, the container includes structure such that the closure is locked at a first position on the container and is held, but not locked, at a second position on the container.

11. The assembly of claim 6, wherein said tamper evidence structure includes a tear band attached to the closure lid, the closure lid being locked to the closure base until removal of the tear band.

12. The assembly of claim 11, wherein the tear band is attached to the closure lid by bridging portions, said bridging portions being sufficiently weak such that the tear band can be separated from the closure lid to which it is attached by pulling on the tear band manually.

13. The assembly of claim 11, wherein recesses are formed in the tear band attached to the closure lid, and the closure base has ribs for extending into said recess, for locking the closure lid and closure base in the closed position.

14. The assembly of claim 6 wherein said container is a container for a dentifrice.

* * * * *